US010195873B2

(12) United States Patent
Zuza Irurueta et al.

(10) Patent No.: US 10,195,873 B2
(45) Date of Patent: Feb. 5, 2019

(54) DRYING CONTROL

(71) Applicant: HEWLETT-PACKARD DEVELOPMENT COMPANY, L.P., Houston, TX (US)

(72) Inventors: Mikel Zuza Irurueta, Barcelona (ES); Francisco Javier Perez Gellida, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/796,025

(22) Filed: Oct. 27, 2017

(65) Prior Publication Data

US 2018/0050548 A1 Feb. 22, 2018

Related U.S. Application Data

(63) Continuation of application No. 15/116,157, filed as application No. PCT/US2014/015185 on Feb. 7, 2014, now Pat. No. 9,849,695.

(51) Int. Cl.

| | |
|---|---|
| ***B41J 11/00*** | (2006.01) |
| ***B41J 29/377*** | (2006.01) |
| ***B41J 2/01*** | (2006.01) |

(52) U.S. Cl.

CPC ..... *B41J 11/0015* (2013.01); *B41J 2/01* (2013.01); *B41J 11/002* (2013.01); *B41J 11/0095* (2013.01); *B41J 29/377* (2013.01)

(58) Field of Classification Search

CPC ..... B41J 11/0015; B41J 2/01; B41J 11/002; B41J 11/0095; B41J 29/377

See application file for complete search history.

(56) References Cited

U.S. PATENT DOCUMENTS

| | | | |
|---|---|---|---|
| 3,955,813 | A | 5/1976 | Edwards |
| 6,256,903 | B1 | 7/2001 | Rudd |
| 2003/0184630 | A1 | 10/2003 | Elgee |
| 2007/0019050 | A1 | 1/2007 | Lim |
| 2008/0018913 | A1 | 1/2008 | Ossman et al. |
| 2008/0213621 | A1 | 9/2008 | Takashima et al. |
| 2010/0192792 | A1 | 8/2010 | Hall et al. |

(Continued)

FOREIGN PATENT DOCUMENTS

| | | |
|---|---|---|
| CN | 1519112 | 8/2004 |
| CN | 1899822 | 1/2007 |

(Continued)

OTHER PUBLICATIONS

Drying in the Corrugated Direct Printing, (Research Paper), Jul. 10, 2011, 10 Pages, http://www.duo-technik.de/fileadmin/Mediendatenbank/Dokumente/PDF/EN/Drying_in_the.

*Primary Examiner* — Bradley Thies
(74) *Attorney, Agent, or Firm* — HP Inc. Patent Department

(57) ABSTRACT

In one example, a printer includes a paper path having a drying area, a printhead near the paper path upstream from the drying area, and a convection dryer to force air simultaneously into an upstream part of the drying area at a first density and into a downstream part of the drying area at a second density less than the first density and to force air into the upstream part of the drying area at a first air speed for a duration and then at a second air speed faster than the first air speed.

11 Claims, 5 Drawing Sheets

(56) References Cited

U.S. PATENT DOCUMENTS

| | | | | |
|---|---|---|---|---|
| 2010/0245506 | A1 | 9/2010 | Platt et al. | |
| 2012/0212537 | A1 | 8/2012 | Takahata | |
| 2013/0300794 | A1 | 11/2013 | Leighton et al. | |
| 2015/0138288 | A1* | 5/2015 | Chen | B41J 11/002 347/102 |

FOREIGN PATENT DOCUMENTS

| | | |
|---|---|---|
| EP | 0568172 | 11/1993 |
| JP | 2012171228 | 9/2012 |
| WO | WO-2013025210 | 8/2011 |

* cited by examiner

DRYING CONTROL

CROSS REFERENCE TO RELATED APPLICATIONS

This is a continuation of U.S. application Ser. No. 15/116,157 filed Nov. 8, 2016, which is itself a 35 U.S.C. 371 national stage filing of international application serial no. PCT/US2014/015185 filed Feb. 7, 2014, each of which applications is incorporated herein by reference in its entirety.

BACKGROUND

There are a number of different types of digital printers, for example LaserJet printers and Inkjet printers. LaserJet printers form images by melting a dry toner onto the media. Inkjet printers deposit printing fluids, for example ink, onto media to create images. After the printing fluid is deposited onto the media, typically paper, the media may travel through a drying area where the fluid is dried. Some printers use media that is in the form of a continuous roll or web. Other printers use sheets of media that are feed through the printer, one after another.

DETAILED DESCRIPTION

One way inkjet printers dry the printing fluids on the media is using infrared radiation from one or more heat lamps. Printing speeds have increased and some printers are using media with widths up to 54 and 64 inches wide. Printers that can print on media with large widths are known as large format printers. With the faster print speeds and wide media, adequately drying the media in a short time using heat lamps is difficult. Therefore large format printers are switching to convection drying.

Convection drying forces heated gas, typically air, over the media to remove the liquid components from the printing fluids on the media. The drying rate for convection drying is a function of the flow rate of the air over the media, the temperature of the air and the moisture content of the air. The air flow rate may be controlled by the speed of the fans in the convection dryer. The air temperature may be controlled by the amount of power supplied to the heaters and the flow rate of the air as it passes by the heaters. The moisture content of the air may be controlled by the power to the heaters, the amount of air that is re-circulated back into the convection dryer and the amount of fluids on the media to be dried. One way to decrease the drying time is to increase the air flow across the media. Unfortunately increasing the air flow can cause problems.

One problem that can occur with a fast air flow rate is that the leading edge of media can be aerodynamically lifted away from the paper guide as it enters the drying area. When the leading edge is aerodynamically lifted away from the paper guide the media may make contact with the drying unit, may make contact with the printhead, may cause uneven drying across the media and/or may block the recirculation pathway in the convection drying unit. When the media contacts the drying unit or the printhead, smudging of the image on the media can occur. When the media contacts the printhead the nozzles in the printhead can be damaged or clogged.

In one example, a printer may use a low air flow rate as the leading edge of the media enters the drying area and a high air flow rate once the leading edge is beyond a threshold distance in the drying area. The printer may use a slow paper advance speed when the air flow speed is low and a fast paper advance speed when the air flow speed is high. By adjusting the paper advance speed to match the air flow rate the amount of moisture removed from the media can be kept substantially constant.

Figure 1:
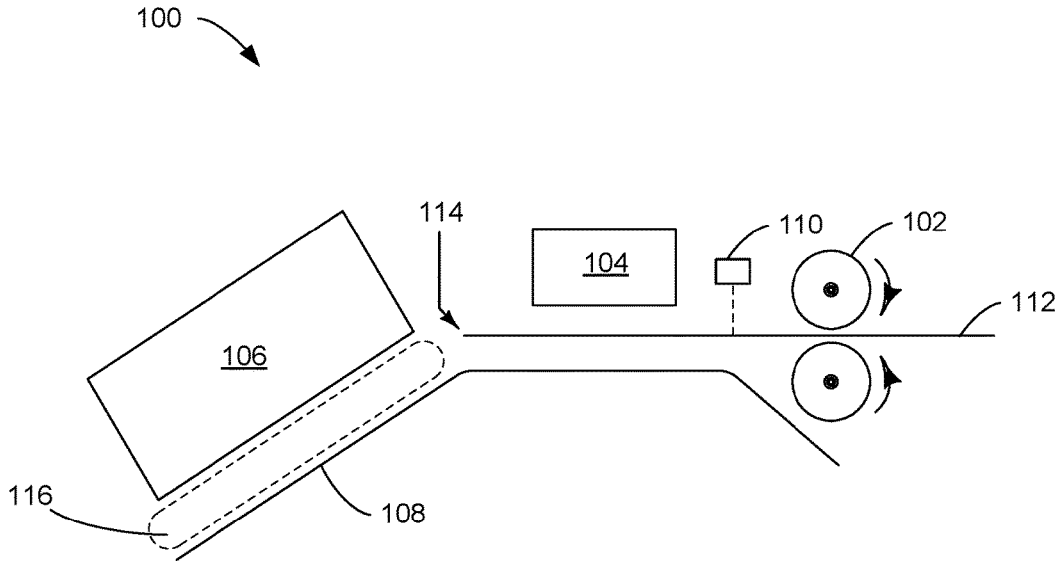
FIG. 1 is a block diagram of an example printer 100.

FIG. 1 is a block diagram of a portion of an example printer 100. Printer 100 comprises a pair of pinch rollers 102, a printhead 104, a convection dryer 106, a paper guide 108 and a sensor 110. A paper path runs between the pair of pinch rollers 102, between the paper guide 108 and the printhead 104, and between the paper guide 108 and the convection dryer 106. A paper path is generally defined as the path that any type of media takes as it travels through the printer. A paper path is not limited to moving just paper through the printer. When the leading edge of media is moving from the pair of pinch rollers 102 towards the printhead 104, the media is said to be moving in a downstream or printing direction in the paper path.

During operation, media is fed along the paper path. The paper guide 108 helps guide and support the media as it is moved along the paper path. A media moving device moves the paper along the paper path. In this example the pair of pinch rollers are the media moving device. Other types of media moving devices may be used, for example: multiple pairs of pinch rollers, belts, take up rollers and the like. The pair of pinch rollers rotate in opposite directions (as shown by the arrows) and move the media along paper guide 108 towards the printhead 104 in the printing direction. Sensor 110 detects the leading edge 114 of the media as it approaches the printhead. Printhead 104 deposits printing fluid onto the media as is passes underneath.

After passing underneath printhead 104, the media passes underneath convection dryer 106. A drying area 116 is shown underneath convection dryer 106. As the media is moved underneath the convention dryer, the liquid components of the printing fluid are heated and evaporated, thereby drying the media. In some cases the convection heater may be used to cure an ink, for example Latex ink, in addition to drying the media. A sheet of media 112 is shown between the pinch rollers 102 with the leading edge 114 approaching the drying area.

The paper path may also include one or more of: an input tray to hold a stack of blank sheets of media, a pick roller to move the top sheet of media towards the pair of pinch rollers, motors and gears to drive the different rollers, additional pairs of pinch rollers, additional sensors, a pair of take-up rollers, an output tray and the like. For clarity, however, these items are not shown.

In one example, printhead 104 may comprise an array of nozzles that extend across the full with of the media. This type of printhead is typically known as a page wide array (PWA). A PWA printer does not sweep the printhead back and forth across the width of the media. The PWA printhead deposits printing fluid across the full width of the media as the media is moved underneath the printhead. Printing fluids are any type of fluid that is deposited on the media during printing. Printing fluids can include black ink, different colors or shades of ink, media pre-treatment fluids, gloss coats and the like.

In another example, printhead 104 may comprise a number of nozzles formed in narrow columns that have a length much smaller than the width of the media. The nozzles may be mounted in a carriage that reciprocates back and forth across the width of the media. The nozzles are arranged such that they travel perpendicular to the length of the column, printing a swath onto the media as they move. The media is advanced after the completion of one or more swaths. Each swath may be printed using one or more passes of the printhead.

Sensor 110 can be any type of sensor that can detect the leading edge of the media, for example an optical sensor or an ultrasonic sensor. Only one sensor is shown, but there may be multiple sensors along the paper path. Sensor 110 is shown in the paper path positioned just after the pair of pinch rollers 102. Sensor 110 is not limited to this position, but could be located in other positions, for example just before or upstream of the drying area 116.

In this example, paper guide 108 is shown with a bend just before the drying area 116. Other geometries may be used, for example the paper guide may form one flat plain underneath both the printhead 104 and the convection dryer 106.

Figure 2:
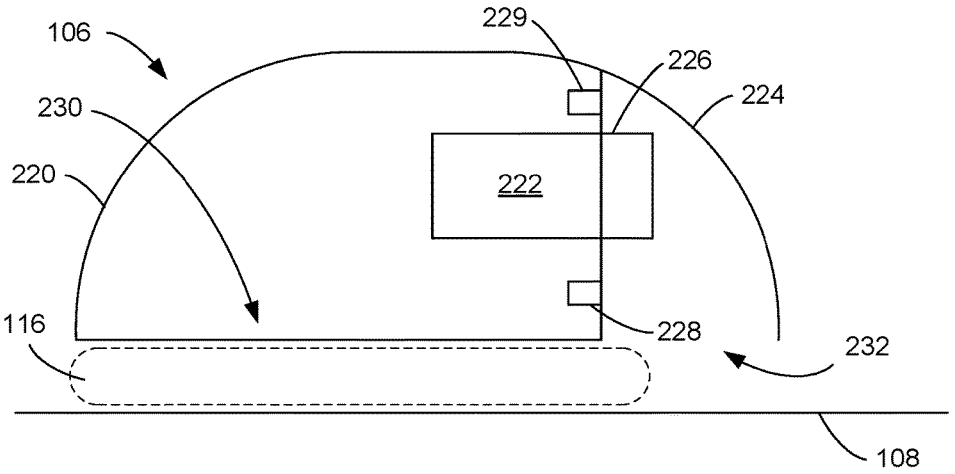
FIG. 2 is a cutaway side view of an example convection dryer 106.

FIG. 2 is a cutaway side view of an example convection dryer 106. Convection dryer 106 comprises a pressure chamber 220, a heater 222, a fan 226, a re-circulation baffle 224, a temperature sensor 229 and a pressure sensor 228. Convection dryer is shown positioned above paper guide 108 with a drying area 116 between the paper guide 108 and convection dryer 106. Fan 226 is coupled to an opening in pressure chamber 220 and can force air into pressure chamber 220 through the opening. Pressure sensor 228 senses the pressure inside the pressure chamber and sends a signal to a controller (see FIG. 5). The controller is coupled to the convection dryer 106 and can adjust the speed of the fan to maintain or change the pressure inside pressure chamber 220.

Heater 222 is adjacent to fan 226 and acts to heat the air that the fan 226 forces into pressure chamber 220. Temperature sensor 229 senses the temperature inside pressure chamber 220 and sends a signal to the controller. The controller can adjust the power supplied to the heater (or to multiple heaters) to control the temperature of the air inside the pressure chamber. There are a pattern of holes formed in the bottom plate 230 of the pressure chamber 220 (see FIG. 4). The holes allow the pressurized air to flow into the drying area 116.

Re-circulation baffle 224 forms a return opening 232 along the bottom of the convection dryer 106. A re-circulation baffle is any structure that directs air from a return opening to the fan intake. Re-cycled air enters the return opening 232 and is drawn towards the back of the fan and then is forced into the pressure chamber 220 by the fan. In one example between 20% and 85% of the air is re-circulated back into the convection dryer 106. In another example between 50% and 70% of the air is re-circulated back into the convection dryer 106.

In one example the convection dryer 106 stretches across the full width of the media. In one example the media is up to 54 inches wide. In this examples there may be 3 fan-heater pairs spaced along the width of the convection dryer. In another example the media may be up to 64 inches wide. In this example there may be 4 fan-heater pairs space along the convection dryer 106. In the cutaway side view shown in FIG. 2 only one fan-heater pair is visible.

Figure 3:
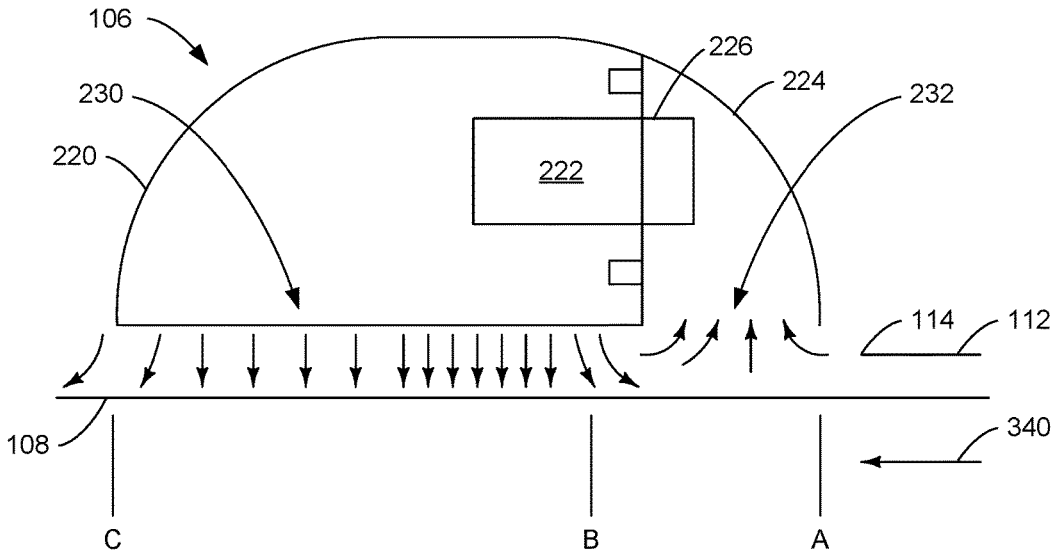
FIG. 3 shows the convection dryer of FIG. 2 with a plurality of arrows indicating example air flow during operation.

FIG. 3 shows the convection dryer of FIG. 2 with a plurality of arrows indicating example air flow during operation. The spacing of the airflow arrows indicates airflow density, with smaller spacing between the arrows indicating a denser pattern and larger spacing between the arrows indicating a coarser pattern. A sheet of media 112 is shown located just before it reaches position A along the paper path. The media moves in a printing direction as shown by arrow 340.

Air flows out of the pressure chamber 220 from the bottom plate 230 towards the paper guide 108. Once the air exits the pressure chamber 220, some of the air is forced towards the re-circulation opening 232 and some of the air is forced out of the printer at position C (on the left side of the convection dryer). Air forced towards the re-circulation opening 232 is drawn back into the convection dryer. Some fresh air is also drawn into the convection dryer 220 near location A. As air is drawn into the re-circulation opening 232 a low pressure area is formed. The low pressure area is located generally between position A and position B.

One way of locating the starting and ending locations of the low pressure area is by measuring the pressure along the paper guide. Another way is to position the leading edge of light weight media in different places in the drying area and slowly ramp the fan speed up to see at what speed (if any) the media is lifted away from the paper guide.

As the leading edge 114 of the sheet of media 112 enters the low pressure area, the media may be aerodynamically lifted towards the convection dryer 106. In general, the faster the air flow, the more likely the edge will be lifted. In one example, the printer uses a slower fan speed in the convection dryer when the leading edge of the media is located before a first position in the paper path, for example position B. In one example position B is located just before the first hole in the bottom plate when traveling in the printing direction. The printer uses a faster fan speed after the leading edge of the media reaches the first position. In one example, the printer advances the media at the same speed independent of the fan speed. In another example, the printer uses a slower media advance speed when the fan is operating at the slower speed, and a faster media advance speed when the fan is operating at the faster speed.

In another example, the convection dryer uses a faster fan speed until the leading edge of the media reaches a first position, for example position A. The convection dryer will use a slower fan speed when the leading edge of the media is between the first position (position A) and a second position, for example position B. And the convection dryer will use the faster fan speed after the leading edge of the media reaches the second position (position B). In this example the slower fan speed will only be used when the leading edge of the media is the low pressure area (i.e. between position A and B).

In another example, the convection dryer may use more than 2 different fan speeds. The convection dryer may switch to the lower fan speed when the leading edge of the media reaches a first position, for example position A. The convection dryer may ramp the fan speed up towards the faster speed as the leading edge of the media travels between the first position and the second position with the fan reaching the faster speed when the leading edge of the media reaches a second position, for example position B.

The faster and slower fan speeds may be different for different media types. For example thin or light weight media may have a very slow fan speed as its slower fan speed and a medium fan speed as its faster fan speed. In contrast, thick or stiff media may have a fast fan speed as its slower fan speed and a very fast fan speed as its faster fan speed. This is because thin or light weight media can be lifted with a smaller aerodynamic force than thick or stiff media. By adjusting the fan speed as the leading edge of the media passes through the low pressure area, the media lifting problem can be addressed without having to change the airflow by changing the mechanical parts. This allows the problem to be addressed more quickly and at lower cost.

Figure 4:
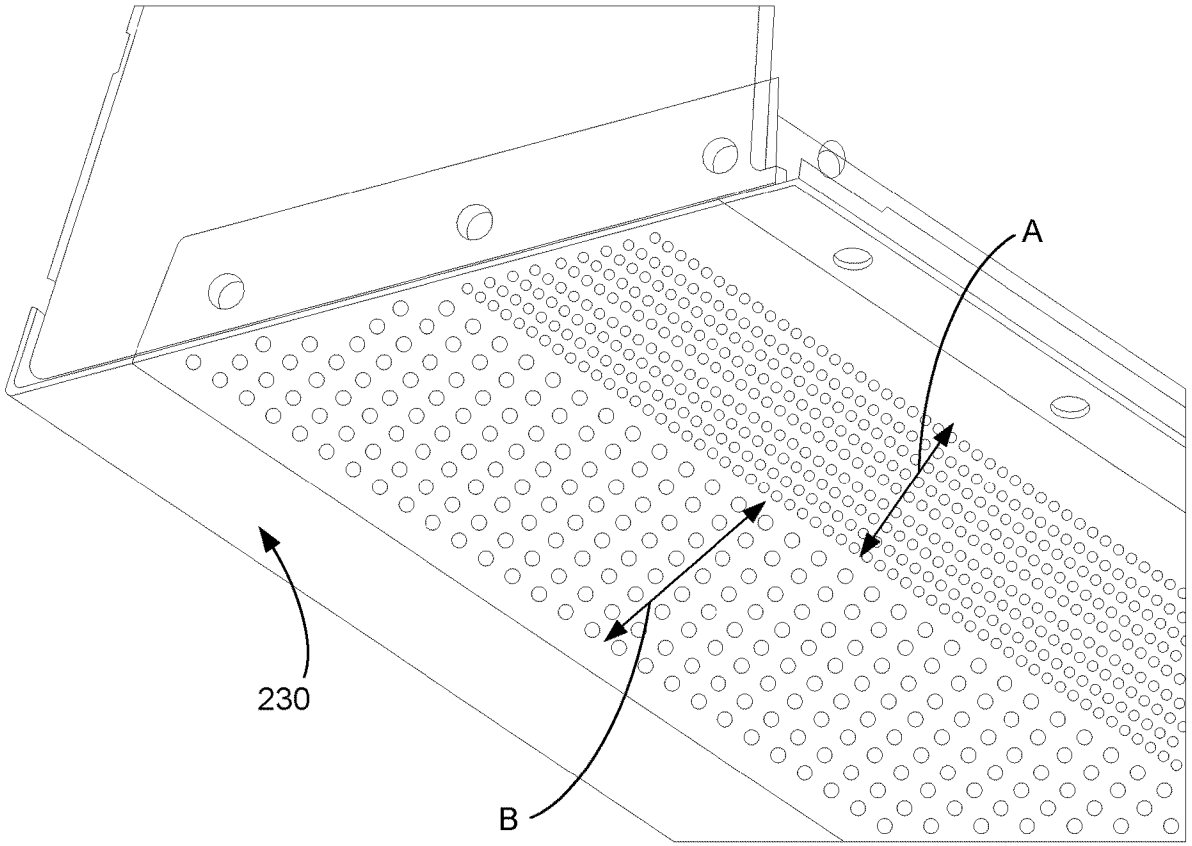
FIG. 4 is an isometric bottom view of an example pressure chamber.

FIG. 4 is an isometric bottom view of an example pressure chamber. A plurality of holes are formed in the bottom plate of the pressure chamber. In one example the holes are all the same size. A first section (section A) has holes that are closely spaced. A second section (section B) has holes that are spaced further apart. Section A allows more air to exit the pressure chamber than section B. There are other designs that can be used to change the amount of air exiting the pressure chamber at different locations on the bottom plate of the convention dryer. For example, the hole spacing could be kept constant and the size of the holes could be varied at different positions along the bottom plate.

Figure 5:
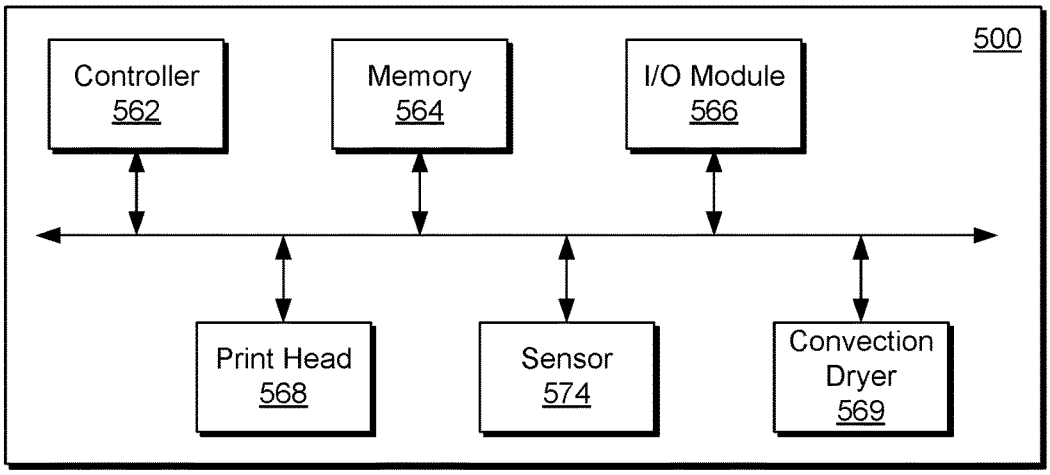
FIG. 5 is an electrical block diagram of an example printer 300.

FIG. 5 is an electrical block diagram of an example printer 500. Printer comprises a controller 562, memory 564, input/output (I/O) module 566, printhead 568, convection dryer 569 and a sensor 574 all coupled together on a bus. In some examples printer may also have a user interface module, an input device, and the like, but these items are not shown for clarity. Controller 562 comprises at least one processor. The processor may comprise a central processing unit (CPU), a micro-processor, an application specific integrated circuit (ASIC), or a combination of these devices. Memory 564 may comprise volatile memory, non-volatile memory, and a storage device. Memory 564 is a non-transitory computer readable medium. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical drives, and flash memory devices.

I/O module 566 is used to couple printer to other devices, for example the Internet or a computer. Printer has machine readable instructions, typically called firmware, stored in the memory 564. The firmware is stored as machine readable instructions in the non-transitory computer readable medium (i.e. the memory 564). The processor generally retrieves and executes the machine readable instructions stored in the non-transitory computer-readable medium to operate the printer and to execute functions. In one example, processor executes machine readable instructions that controls the convection dryer.

Figure 6:
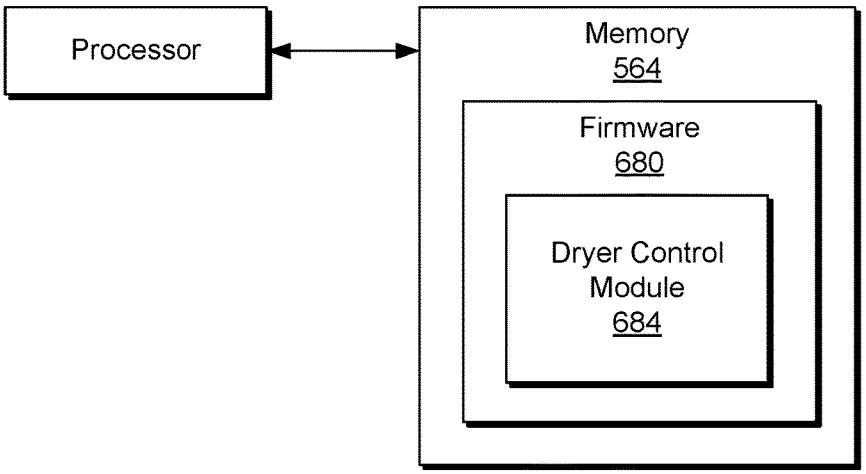
FIG. 6 is an example block diagram of the processor coupled to memory.

FIG. 6 is an example block diagram of the processor coupled to memory. Memory 564 contains firmware 680. Firmware 680 contains a dryer control module 684. The processor executes the machine readable instructions in the dryer control module 684 to adjust the fan speeds in the convection dryer. The dryer control module may use the method shown in FIG. 7 to adjust the fan speeds in the convection dryer.

Figure 7:
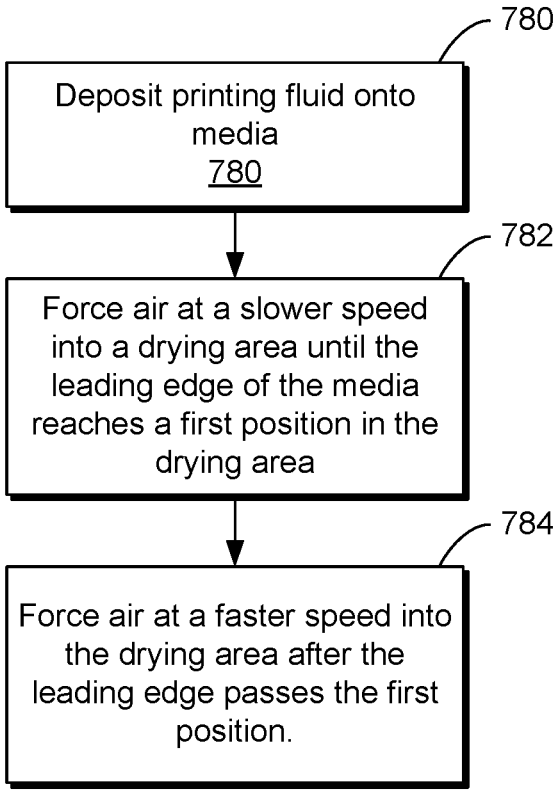
FIG. 7 is an example flow chart for a method of adjusting the fan speed in a convection dryer.

FIG. 7 is an example flow chart for a method of adjusting the fan speed in a convection dryer. At 780 printing fluid is deposited onto media. At 782 air is forced at a slower speed into a drying area adjacent to the convection dryer until the leading edge of the media reaches a first position in the drying area. At 784 air is forced at a faster speed into a drying area after the leading edge of the media reaches the first position in the drying area.

The invention claimed is:

1. A tangible non-transitory computer readable medium having machine readable instructions thereon that when executed cause a printer to:

force air into a drying area at a first air speed until a leading edge of a media reaches a speed change location in the drying area; and force air into the drying area at a second air speed faster than the first air speed after the leading edge of the media reaches the speed change location in the drying area.

2. The medium of claim 1 having instructions thereon that when executed cause the printer to:

deposit printing fluid onto the media; and advance the leading edge of the media in a printing direction through the drying area.

3. The medium of claim 2, wherein the instructions to advance the leading edge of the media through the drying area includes instructions to:

advance the leading edge of the media in the printing direction at a first media speed until the leading edge reaches the speed change location in the drying area; and advance the leading edge of the media in the printing direction at a second media speed faster than the first media speed after the leading edge has reached the speed change location in the drying area.

4. The medium of claim 3 having instructions thereon that when executed cause the printer to select the first air speed and the second air speed based on a type of media.

5. A printer, comprising:

a paper path having a drying area;

a printhead near the paper path upstream from the drying area in a direction media is moved along the paper path; and a convection dryer to:

force air simultaneously into an upstream part of the drying area at a first density and into a downstream part of the drying area at a second density less than the first density; and force air into the upstream part of the drying area at a first air speed for a duration and then at a second air speed faster than the first air speed.

6. The printer of claim 5, wherein the dryer includes a pressure chamber and a plate having an arrangement of holes therein to allow pressurized air to flow out of the pressure chamber into the upstream part of the drying area at the first density and into the downstream part of the drying area at the second density.

7. The printer of claim 5, comprising a media moving device to move a media through the drying area at a first media speed for the duration and then at a second media speed faster than the first media speed.

8. The printer of claim 5, wherein the dryer is to force air into the upstream part of the drying area at the first air speed until a leading edge of a media reaches a speed change location in the drying area and then at the second air speed after the leading edge of the media reaches the speed change location in the drying area.

9. The printer of claim 5, wherein the dryer includes at least one fan and the printer comprises:

a sensor to detect a leading edge of media in the paper path; and a controller coupled to the at least one fan and the sensor to run the at least one fan at a slower fan speed after the leading edge of media reaches a first location in the drying area and at a faster fan speed after the leading edge of media reaches a second location in the drying area downstream from the first location.

10. A printer, comprising:

a paper path having a drying area;

a printhead near the paper path upstream from the drying area in a direction media is moved along the paper path; and a convection dryer including:

a pressure chamber having an arrangement of holes therein to allow pressurized air to flow out of the pressure chamber into an upstream part of the drying area at a first density and into a downstream part of the drying area at a second density less than the first density; and at least one variable speed fan to pressurize the pressure chamber to force air through the holes at a first air speed until a leading edge of a media reaches a speed change location in the drying area and then at a second air speed faster than the first air speed after the leading edge of the media reaches the speed change location in the drying area.

11. The printer of claim 10, comprising: a sensor to detect a leading edge of media in the paper path; and a controller coupled to the at least one fan and the sensor to run the at least one fan at a slower fan speed after the leading edge of media reaches a first location in the drying area and at a faster fan speed after the leading edge of media reaches the speed change location in the drying area downstream from the first location.

* * * * *